US008402663B2

(12) United States Patent
McHenry et al.

(10) Patent No.: US 8,402,663 B2
(45) Date of Patent: Mar. 26, 2013

(54) TWO-PIECE HAND TOOL

(75) Inventors: William J. McHenry, Wyoming, RI (US); Jason L. Williams, Wyoming, RI (US)

(73) Assignees: William J. McHenry, Wyoming, RI (US); Jason Williams, Sterling, CT (US)

( * ) Notice: Subject to any disclaimer, the term of this patent is extended or adjusted under 35 U.S.C. 154(b) by 364 days.

(21) Appl. No.: 12/854,220

(22) Filed: Aug. 11, 2010

(65) Prior Publication Data

US 2012/0036721 A1 Feb. 16, 2012

(51) Int. Cl.
*B26B 1/08* (2006.01)

(52) U.S. Cl. ..... 30/162; 30/335

(58) Field of Classification Search ..... 30/151, 30/162, 164, 335
See application file for complete search history.

(56) References Cited

U.S. PATENT DOCUMENTS

| | | | | | |
|---|---|---|---|---|---|
| 135,893 | A | * | 2/1873 | Day | 30/118 |
| 174,417 | A | | 3/1876 | Evans | |
| 436,888 | A | | 9/1890 | Von Blutzingslowen et al. | |
| 472,104 | A | | 4/1892 | Von Bultzingsiowen | |
| 475,306 | A | | 5/1892 | Franklin | |
| 515,743 | A | | 3/1894 | Von Blutzingslowen | |
| 821,176 | A | | 5/1906 | Leland | |
| 845,792 | A | | 3/1907 | Jenkins | |
| 969,909 | A | | 9/1910 | Schrade | |
| 1,024,749 | A | | 4/1912 | Sjoberg | |
| 1,179,111 | A | | 4/1916 | Knowlton | |
| 1,215,665 | A | | 2/1917 | Landis | |
| 1,258,150 | A | | 3/1918 | Schrade | |
| 1,413,954 | A | | 4/1922 | Ball et al. | |
| 1,434,388 | A | * | 11/1922 | Hughes | 30/320 |
| 1,453,897 | A | | 5/1923 | Franz | |
| 1,510,198 | A | * | 9/1924 | Scott | 30/162 |
| 1,859,158 | A | | 5/1932 | Pernek, Sr. | |
| 1,888,887 | A | | 11/1932 | Readman | |
| 2,022,876 | A | * | 12/1935 | Anderson | 30/162 |
| 2,146,313 | A | | 2/1939 | Putman | |
| 2,197,136 | A | | 4/1940 | Share et al. | |
| 2,260,141 | A | | 10/1941 | Hanie | |
| 2,342,832 | A | | 2/1944 | Borchers | |
| 2,477,705 | A | | 8/1949 | Sweet | |
| 2,580,495 | A | | 1/1952 | Woods | |
| 2,584,460 | A | | 2/1952 | Jacobs, Jr. | |
| 2,681,244 | A | | 6/1954 | Noecker | |
| 2,854,745 | A | | 10/1958 | Braverman | |
| 3,192,624 | A | | 7/1965 | Gringer | |
| 3,313,564 | A | | 4/1967 | Pultz | |
| 3,496,590 | A | | 2/1970 | Yates | |
| 3,872,417 | A | | 3/1975 | Hufschmid | |
| 3,878,347 | A | | 4/1975 | Roeser | |
| 3,990,471 | A | | 11/1976 | Schutzer et al. | |
| 4,005,525 | A | | 2/1977 | Gringer | |

(Continued)

OTHER PUBLICATIONS

International Search Report, Written Opinion, and search history for PCT/US11/47155, which is a PCT of the present application.

(Continued)

*Primary Examiner* — Hwei C Payer
(74) *Attorney, Agent, or Firm* — Salter & Michaelson

(57) ABSTRACT

A tool such as a knife or other hand tool has only two pieces, a handle and a blade or other implement. The blade is movable from a fully retracted position to an extended position and the blade may be locked in both the retracted and extended positions.

12 Claims, 5 Drawing Sheets

U.S. PATENT DOCUMENTS

| | | | |
|---|---|---|---|
| 4,177,367 | A | 12/1979 | Tirone et al. |
| 4,200,977 | A | 5/1980 | Kageyama et al. |
| 4,265,017 | A | 5/1981 | Collins |
| 4,277,888 | A | 7/1981 | Szabo |
| 4,354,313 | A | 10/1982 | Naifeh |
| 4,394,553 | A | 7/1983 | Feil |
| 4,407,538 | A | 10/1983 | Bauer |
| 4,431,884 | A | 2/1984 | Flumignan et al. |
| 4,447,950 | A | 5/1984 | Mizelle |
| 4,663,845 | A | 5/1987 | Weimann |
| 4,860,790 | A | 8/1989 | Scaramucci |
| 4,884,307 | A | 12/1989 | Flood |
| 4,926,555 | A | 5/1990 | Lemaire |
| 4,939,839 | A | 7/1990 | Gorst |
| 4,947,552 | A | 8/1990 | Barnes |
| 4,974,987 | A | 12/1990 | Smock |
| 4,985,998 | A | 1/1991 | Howard |
| 5,104,164 | A | 4/1992 | Sieg |
| 5,142,113 | A | 8/1992 | Miyata |
| 5,371,948 | A | 12/1994 | Liffiton |
| 5,515,610 | A | 5/1996 | Levin et al. |
| 5,546,662 | A | 8/1996 | Seber et al. |
| 5,581,890 | A | 12/1996 | Schmidt |
| 5,585,774 | A | 12/1996 | Bennett |
| 5,621,973 | A | 4/1997 | Seber et al. |
| 5,737,841 | A | 4/1998 | McHenry et al. |
| 5,760,672 | A | 6/1998 | Wang |
| 5,790,010 | A | 8/1998 | Schwab |
| 5,875,552 | A | 3/1999 | Chen |
| 5,909,930 | A | 6/1999 | Ragland et al. |
| 6,006,433 | A * | 12/1999 | Baltazar ..... 30/162 |
| 6,122,829 | A | 9/2000 | McHenry et al. |
| 6,170,104 | B1 | 1/2001 | Seber et al. |
| 6,223,628 | B1 | 5/2001 | Barron |
| 6,226,873 | B1 | 5/2001 | Lkumura |
| 6,269,993 | B1 | 8/2001 | Ebejer et al. |
| 6,393,628 | B1 | 5/2002 | Kellogg |
| 6,550,832 | B2 | 4/2003 | McHenry et al. |
| 6,675,484 | B2 | 1/2004 | McHenry et al. |
| 6,948,250 | B1 | 9/2005 | Caiafa, Jr. et al. |
| 7,101,382 | B2 | 9/2006 | George et al. |
| 7,305,769 | B2 | 12/2007 | McHenry et al. |
| 7,562,455 | B2 | 7/2009 | McHenry et al. |
| 2006/0207102 | A1 | 9/2006 | Bezold et al. |

OTHER PUBLICATIONS

A series of 10 photographs of an "out the front" knife, assembled and dissambled, knife circa 2000.

* cited by examiner

TWO-PIECE HAND TOOL

FIELD OF THE INVENTION

This invention relates to hand tools such as knives that are equipped with blades and/or other implements that are attached to a handle and which are configured for stowing the blades and/or other implements in the handle, and more particularly, to a hand tool comprising only two-pieces, a handle and an implement, in which the implement may be moved from a first position in which the implement is locked within the handle and a second position in which the implement is locked in a working position.

BACKGROUND

In its most basic and simplest form, a folding pocket knife has a handle and a blade pivotally attached to the handle with a shaft. The blade may be pivoted from a closed position in which the sharp, or working portion of the blade is safely stowed in the handle, and an open position in which the working portion of the blade is exposed. Of course there are many, many hundreds of designs of folding knifes and these range from the simplest designs that have relatively few mechanical parts, to exceedingly complicated designs with mechanically complex structures that may include automated or semi-automated opening and closing mechanisms that require various springs and associated parts, locks, safety mechanisms and a myriad of other features.

Likewise, there are many different styles of knifes and tools that have stowable blades other than the standard folding knife with a pivoting blade. To name an example, knives that have blades that extend and retract longitudinally are often called "out the front" knives because the blade extends and retracts out the "front" of the handle. An example of an out the front knife is shown in U.S. Pat. No. 7,305,769, which is assigned to the assignee of the present application. The mechanisms utilized in the knives described in the '769 patent are quite complex. As another example, Balisong knives, which are also called "butterfly" knives, have two handle portions—a safe handle and a bite handle—both pivotally attached to the tang of a blade. There are numerous styles and variations of Balisong knives, but even in their most fundamental and simple form these knives necessarily include many different parts that cooperate to make the knives functional.

Many knife enthusiasts and designers strive for simplicity in design and structure. Ideally, a simple mechanical design minimizes the number of parts and the interactions between the parts. Nonetheless, even in the simplest form, with any knife that has a folding or retractable blade necessarily requires several parts that must be assembled and work together.

There is an ongoing need therefore for knife and tool designs that minimize the number of parts and therefore achieve the simplest possible mechanism.

The present invention is a knife that has only two parts, a handle and a blade. The blade is movable from a closed position in which the blade is stowed safely in the handle and an open position in which the blade is in a working position. Moreover, despite the knife having only two parts, the knife includes a lock that secures the blade safely in the closed position, and a lock that secures the blade when in the open position. The locking mechanism utilized in the knife described herein is a novel and unique adaptation of the actuating mechanisms described in U.S. Pat. Nos. 6,675,484 and 6,550,832, both of which are assigned to the assignee of the present application and the disclosures of both of which are incorporated herein by this reference.

BRIEF DESCRIPTION OF THE DRAWINGS

The invention will be better understood and its numerous objects and advantages will be apparent by reference to the following detailed description of the invention when taken in conjunction with the following drawings. The drawings illustrate the invention embodied in a knife. But as will be appreciated, the invention described and claimed herein may be embodied in other tools.

DETAILED DESCRIPTION OF THE PREFERRED EMBODIMENTS

Figure 1:
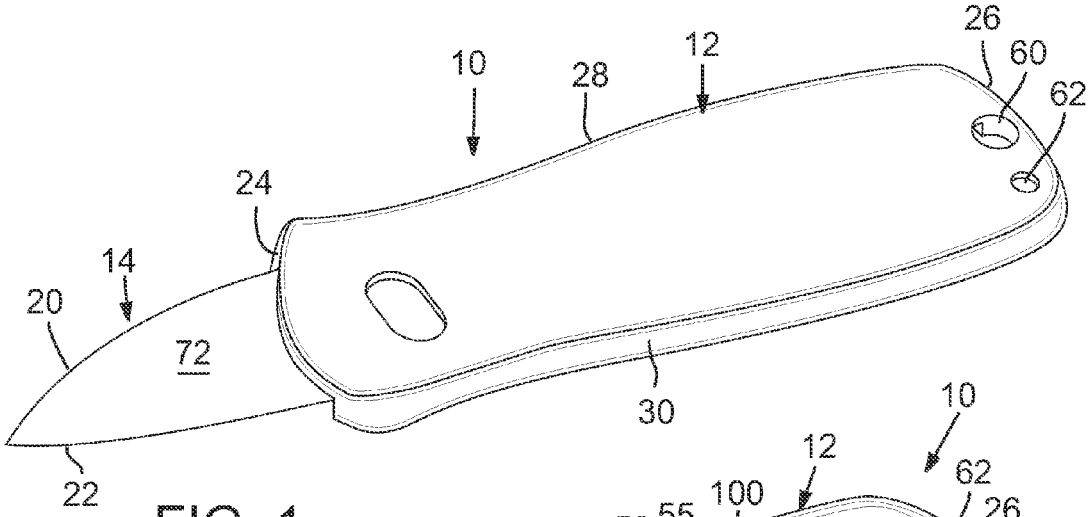
FIG. 1 is a perspective view of a knife embodying the present invention, showing the back side of the handle with the blade in the open or extended position.
Figure 2:
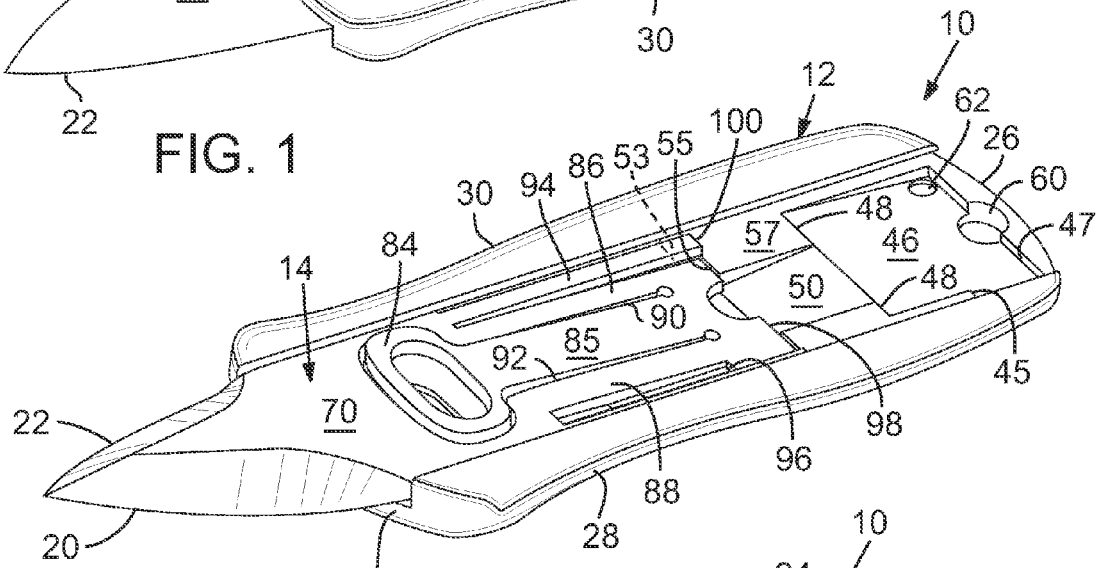
FIG. 2 is a perspective view of the front side of the knife shown in FIG. 1.

A first illustrated embodiment of a two piece knife 10 according to the present invention is illustrated in FIGS. 1 through 11. As noted previously and as reiterated at various points in this specification, the principles of the invention extend beyond knives to other tools. However, for the purposes of thoroughly describing and enabling the invention, this description and the accompanying drawings are of the invention embodied in a knife.

Knife 10 has only two parts, a handle 12 and a blade 14. It will be appreciated that the specific shape of the handle and blade may vary widely from the shapes shown in the drawings. With that said, the blade 14 includes a working portion 16, which is defined generally as that portion of the blade with sharpened edges that extends beyond the handle when the blade is in the open position, as in FIGS. 1 and 2, and a tang portion 18, which is defined generally as that portion of the blade that is retained within the bounds of the handle 12 at all times (FIG. 4). The working portion 16 of blade 14 shown in FIG. 3 includes opposed sharpened edges 20 and 22 but it is to be understood that the working portion of the blade may take on numerous configurations.

As a linguistic convention, relative directional terms used herein correspond to the geometric center of the knife 10 and how the knife is used in normal usage conditions. Using this convention, the front end 24 of the handle is the end of the handle 12 out of which blade 14 extends and into which the blade retracts into the handle. The front side of the knife is the side shown in FIG. 2 that includes user-operated features associated with the lock; the back side of the knife is the side shown in FIG. 1. The "rear" or butt end 26 of the handle is the end of the handle opposite the forward end. The "upper" part of the blade and handle is that portion nearest sharpened edge 22, and the "lower" portion of the blade is nearest the sharpened portion 20. "Inner" or "inward" refers to the geometric center of the knife 10, and so on.

Various structural features of the handle 12 and blade 14 are best described with reference to the exploded view of FIG. 3. Handle 12 first. The handle 12 is generally a flattened elongate member that has opposed lateral edges 28 and 30, each of which defines a longitudinal channel (32 and 34) into which, as detailed below, outer rails of the blade travel. Each of the channels 32 and 34 is open at the rear of the handle—the open ends are identified with reference numbers 36 and 38, respectively, and each of the channels has a closed front end at 40, 42. The central portion of the handle, identified generally with reference number 13, is the flat portion of the handle between channels 32 and 34 and defines a blade-receiving area. Central portion 13 includes several structures that are part of the locking features of the knife 10. The "floor" 44 of handle 12 in central portion 13 is that portion of the handle on which blade 14 rests between channels 32 and 34. The floor 44 defines a planar surface. There are various recessed portions formed in floor 44, some of which slope relative to the plane of floor 44 and which are thus angled relative to the plane of floor 44. Beginning at the rear end 26 of the handle, a recessed portion 46 (referred to at times as the rear lock relief) slopes upwardly from the rear of the handle and terminates at a rear fulcrum 48, which is at the same level as and thus coplanar with floor 44. The rear lock relief includes a stepped in portion at shoulder 45 along one lateral side of the rear lock relief that defines and is referred to as a shoulder or rear lock engagement 45. The rear edge of rear lock 46 relief is defined by rear edge 47. A second recessed portion 50 is located immediately forward of rear lock relief 46 and is defined by a sloping central ramp that has a width L1 and which slopes downwardly and forwardly from rear fulcrum 48 and terminates at a third recessed portion 52, which is identified as the front lock relief 52. Moving in the forward direction, front lock relief terminates at a front fulcrum 54, which is toward the front 24 of the handle 12. One side of the second recessed portion or ramp 50 is identified as lateral shelf 57. The upper surface of lateral shelf 57 is coplanar with floor 44 and includes a forward extension 53, the purpose of which is detailed below. The front lock relief 52 defines a surface that is parallel with floor 44 but is recessed in handle 12 so the front lock relief lies below the level of floor 44 and front fulcrum 54 is at the same level as the floor. The front lock relief also includes a stepped edge 59 along one lateral side of the relief. The rearward most edge of front lock relief 52 is an edge 55 that defines a front lock engagement. Moving toward the front 24 of the handle from front fulcrum 54, an actuator relief 56 is defined as a recessed portion beginning at front fulcrum 54 and sloping downwardly, forwardly, into the handle, terminating a front terminus 58.

Returning to the rear end 26 of handle 12, a lanyard hole 60 is provided for attachment of a lanyard (not shown) to the handle and a disassembly hole 62, which is detailed later, is located in rear lock relief 46 along one side of the relief.

Figure 3:
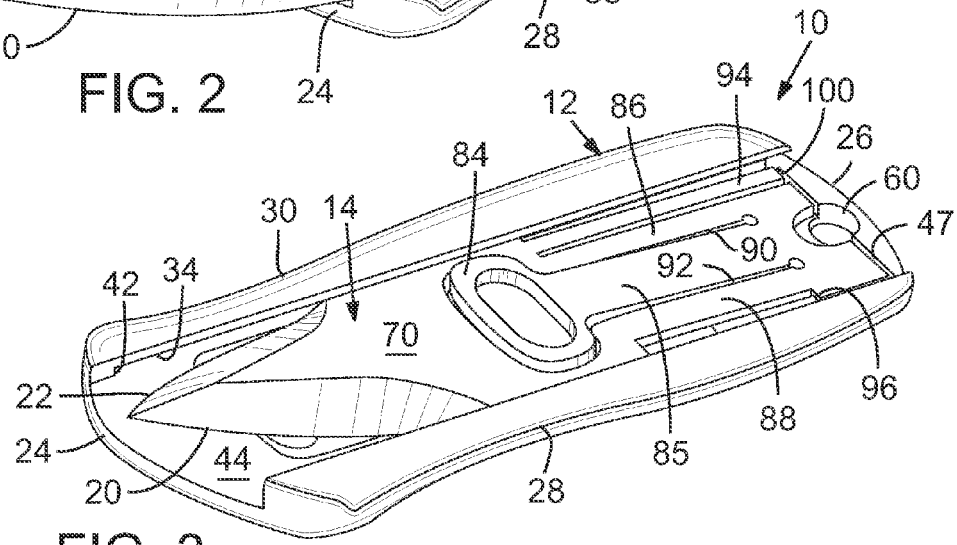
FIG. 3 is a perspective view of the front side of the knife similar to FIG. 2, expect the blade is shown in the closed or retracted position.
Figure 4:
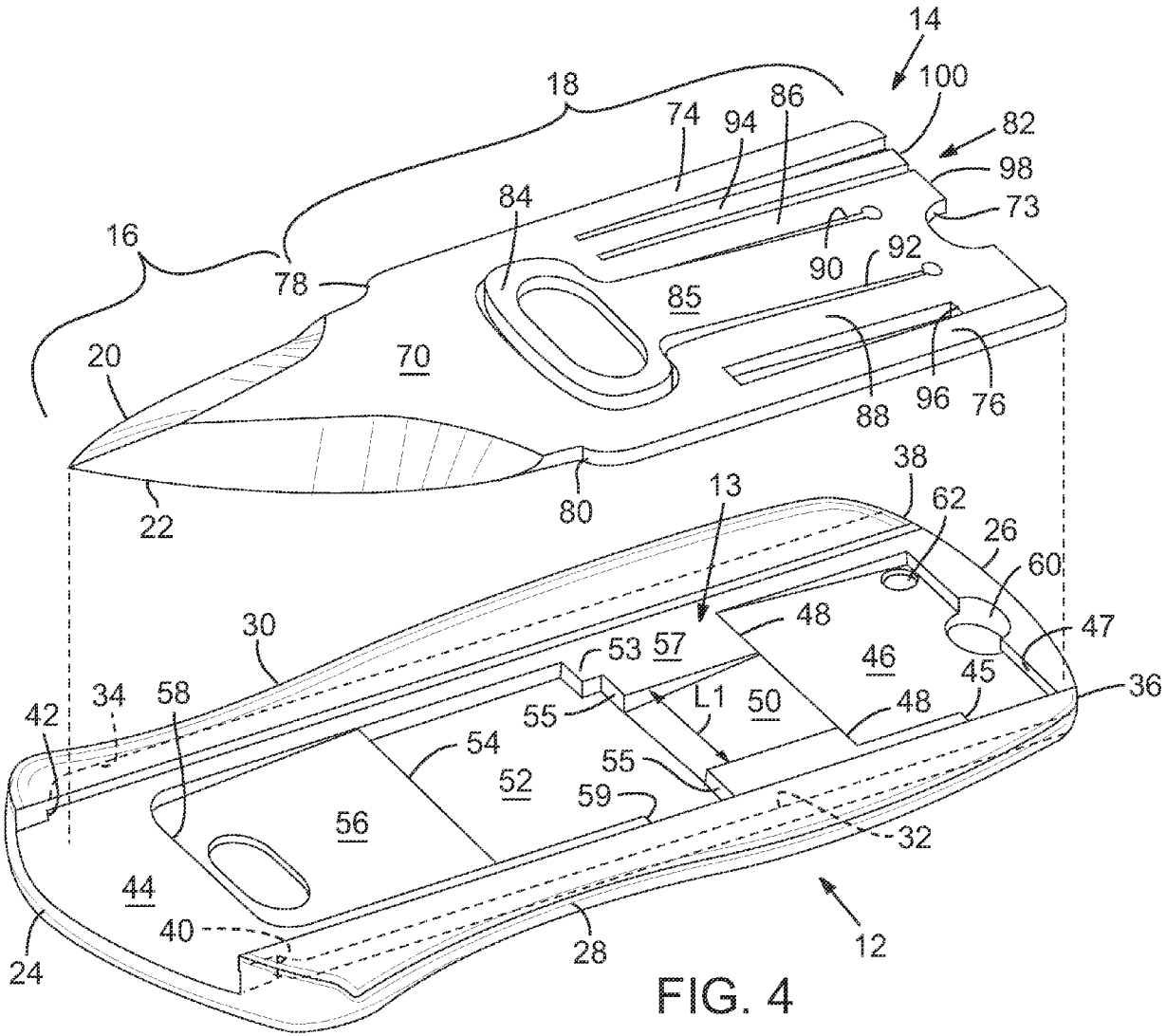
FIG. 4 is a perspective exploded view of the knife shown in FIG. 3 illustrating the blade and the handle in relation to one another.

Turning to blade 14 in FIG. 3, as noted earlier, the blade 14 is preferably a unitary member that is generally flat along one plane and defined by a working portion 16 and a tang portion 18. The outer surface 70 of blade 14 is that side of the blade that is exposed when the blade is in the fully retracted position of FIG. 3. The inner surface 72 (see FIG. 1) of blade 14 is that side of the blade that is opposite outer surface 70. Inner surface 70 is planar and in the assembled knife, inner surface 72 resides on, faces, and slides over central portion 13 of floor 44 of handle 12. Again beginning with the portion of the blade that in the assembled knife 10 is adjacent the butt end 26 of handle 12, blade 14 includes a notch 73 that aligns with lanyard hole 60 when the blade and handle are assembled to allow attachment of a lanyard (not shown). The outer lateral edges of the blade define rails 74 and 76 that terminate at a forward end at inwardly-stepped shoulders 78 and 80. The central portion of tang portion 18 includes a locking mechanism identified generally with reference number 82. Locking mechanism 82 comprises several components, all of which are integrally formed with the blade: an actuator pad 84 that is at the end of a lever arm 85, opposed spring beams 86 and 88 that are located on the lateral sides of the lever arm and which are attached thereto at the end of the lever arm opposite the actuator pad 84. The opposed spring beams are defined by longitudinal slots 90 and 92 that are cut into blade 14. Locking mechanism 82 further includes: a rearward travel stop beam 94, a closed lock edge 96 and an open lock edge 98 (which is the rear edge of the blade 14). The width of lever arm 85 is slightly less than L1, which is the width of ramp 50.

Figure 5:
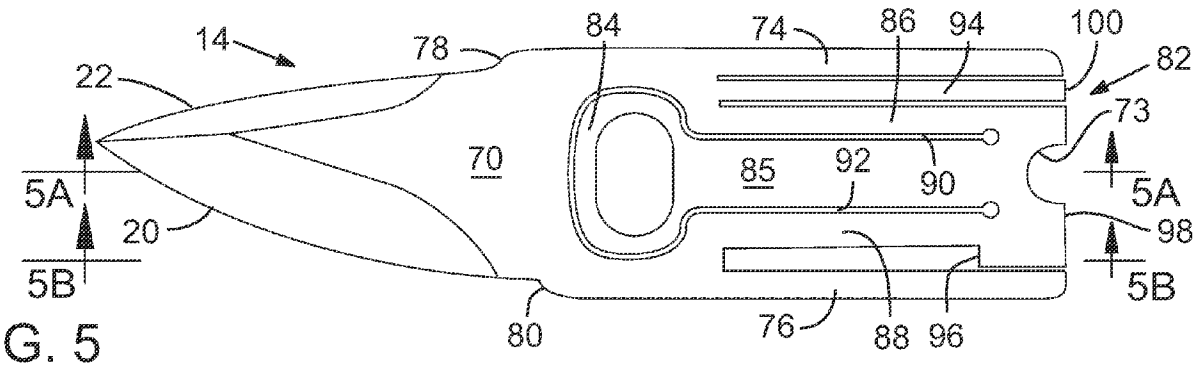
FIG. 5 is a top plan view of the blade.
Figure 5A:
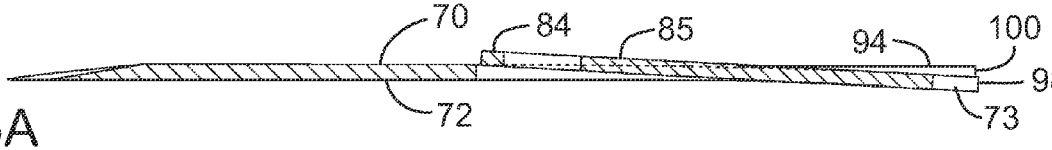
FIG. 5A is a cross sectional view of the blade taken along the line 5A-5A of FIG. 5.
Figure 5B:
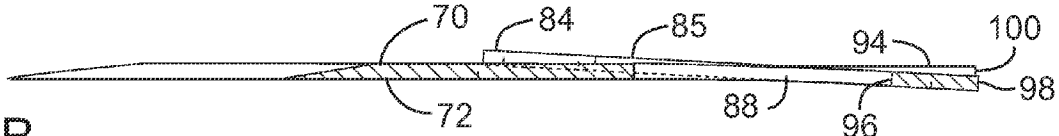
FIG. 5B is a cross sectional view of the blade taken along the line 5B-5B of FIG. 5.
Figure 6:
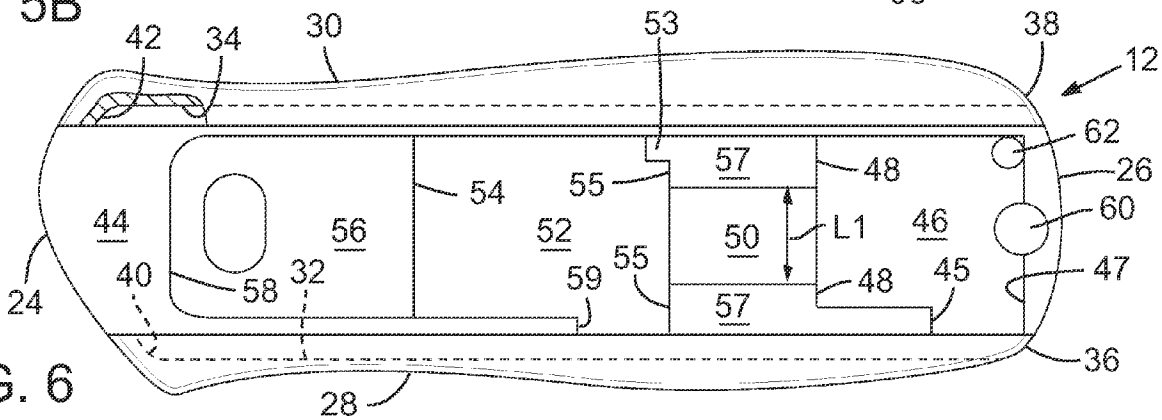
FIG. 6 is a top plan view of the handle showing a portion of the handle removed to expose one of the channels in the handle.

As noted, blade 14 is shown as formed from a unitary or monolithic piece of material and preferably a resilient material that is typical of knife blades and which retains a normal resting position. During manufacture of the blade, various portions of the locking mechanism 82 are biased relative to the planes defined by outer surface 70 and inner surface 72 in order to facilitate the locking action. Specifically, with reference to FIGS. 5A and 5B, surface 72 defines a planar surface on the inner side of the blade—that is, the side of the blade that faces floor 44 of handle 12 in the assembled knife and outer surface 70 defines a surface that is parallel with surface 72. Lever arm 85 is biased so that the actuator pad 84 at the forward end of the lever arm normally lies above the plane defined by surface 70 and open lock edge 98 lies below the plane defined by surface 72. In the resting state illustrated in FIG. 5B it may be seen that closed lock edge 96 also lies below the plane of surface 72. As best seen in FIG. 4, rearward travel stop beam 94 is biased so that its rearward most edge 100 is normally below the plane of surface 72. Because the blade 14 and the components of locking mechanism 82 are fabricated from resilient materials, the opposed spring beams 86 and 88 provide a resilient spring force to the lever arm. As detailed below, pressing actuator pad downwardly against the upward force of the spring beams causes the open lock edge 98 to move upwardly.

Figure 7:
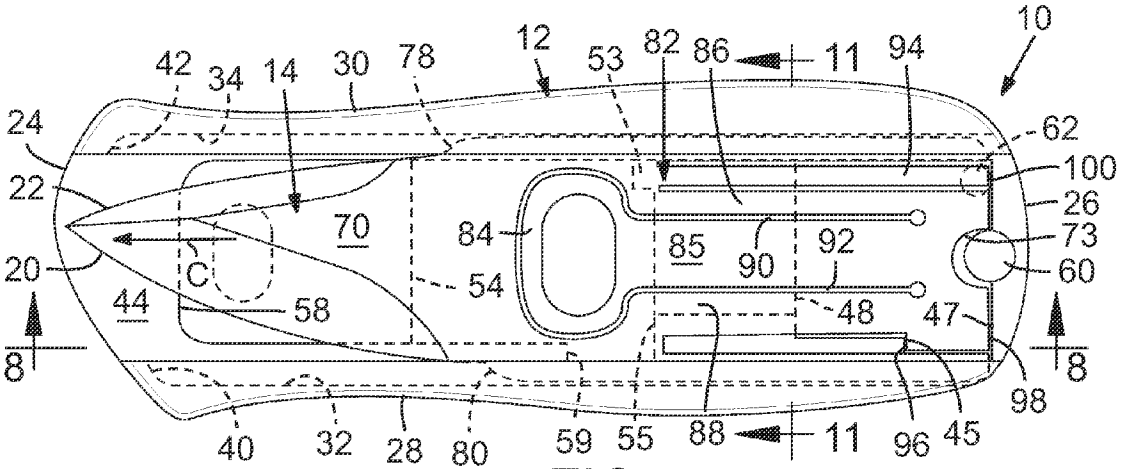
FIG. 7 is a top plan view of the knife according to the present invention illustrating various structures in phantom lines and showing the blade in the retracted position.
Figure 8:
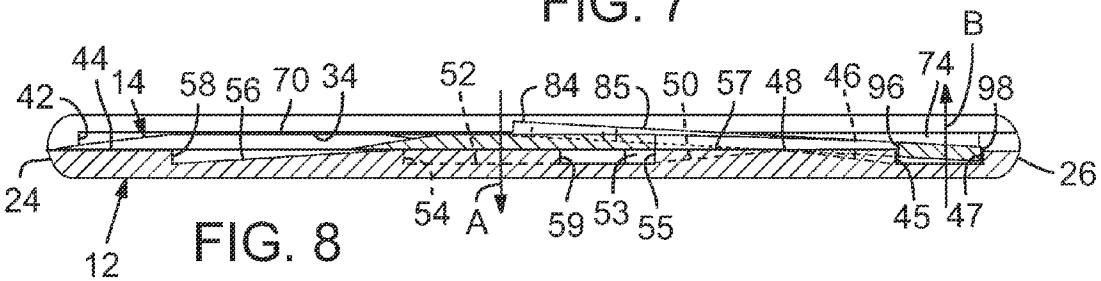
FIG. 8 is a cross sectional view taken along the line 8-8 of FIG. 7.
Figure 11:
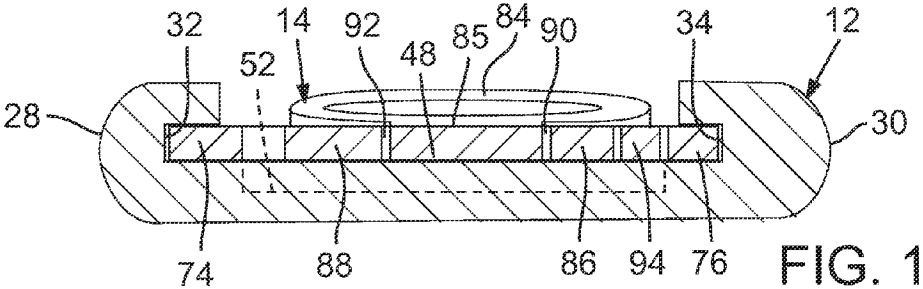
FIG. 11 is a cross sectional view taken along the line 11-11 of FIG. 7.
Figure 9:
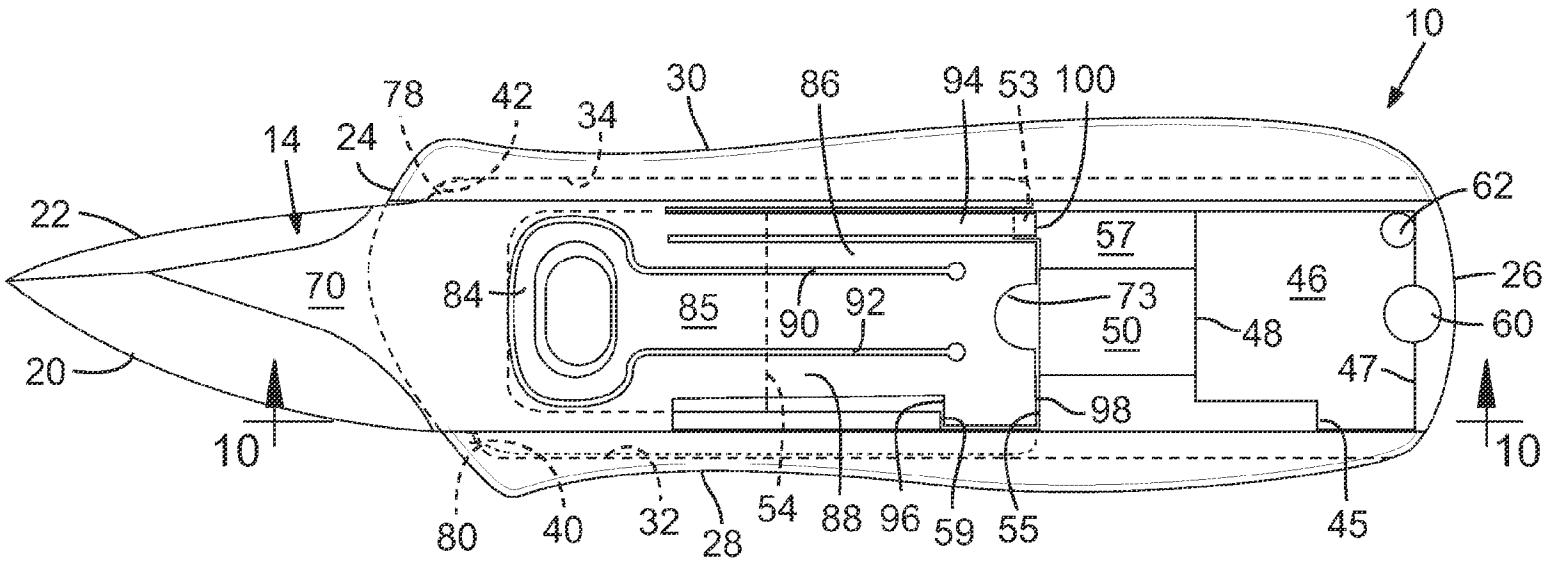
FIG. 9 is a top plan view of the knife according to the present invention illustrating various structures in phantom lines and showing the blade in the extended position.
Figure 10:
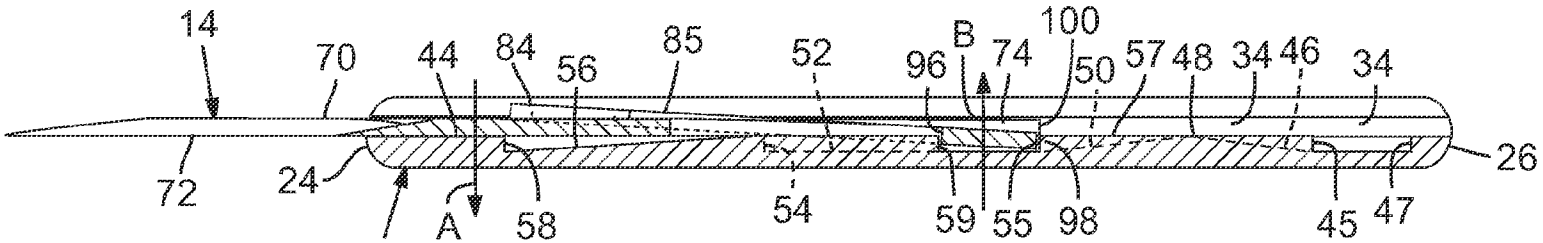
FIG. 10 is a cross sectional view taken along the line 10-10 of FIG. 9.

Assembly and operation of knife 10 will now be detailed with particular reference to FIGS. 7 through 11. In FIGS. 7, 8 and 11 the blade 14 is in the closed/retracted and locked position. In FIGS. 9 and 10 the blade is in the open/extended and locked position.

Starting with the blade in the retracted and locked position (FIGS. 7, 8, 11), it may initially be seen that the entire blade 14 is retained on handle 12 such that no portion of the blade extends out of the peripheral edges of the handle. As such, the working portion 16 of the blade 14 is safely stowed in the handle and sharpened edges 20 and 22 are not exposed. The blade 14 is assembled with handle 12 by sliding the forward end of the blade (i.e., the end with sharpened edges 20 and 22) into the rear end 26 of the handle such that rails 74 and 76 slide into channels 34 and 32, respectively, in handle 12. The width of blade 14 between the outer edges of the rails 74 and 76 is just slightly narrower than the width of handle 12 between the channels 32 and 34 and as such, the blade slides easily into the handle. The tolerances and dimensions between the blade and the handle may be adjusted as necessary and desired. Moreover, if desired, friction-reducing materials may be used to make relative movement between the blade and the handle easier, such as nylon casings installed in the channels.

As described above, both lever arm 85 and rearward travel stop beam 94 are biased so that open lock edge 98 (of lever arm 85) and rearward edge 100 (of rearward travel stop beam 94) are normally positioned below the plane defined by inner surface 72 of blade 14. Blade 14 is slid into handle 12 until via the rear end 26 of the handle. As the blade is thus slid, with rail 74 in channel 34 and rail 76 in channel 32, both the rearward travel stop beam 94 and lever arm 85 are deflected upwardly by floor 44 at rear end 26 of the handle until rearward travel stop beam 94 and lever arm 85 pass over rear edge 47, at which point both the rearward travel stop beam 94 and lever arm 85 snap into their resting positions (FIG. 8) in the recessed portion defined as rear lock relief 46. In this position, the blade 14 is locked relative to the handle and cannot be moved without actuating the locking mechanism 82, as described below.

In the locked and retracted position, the blade 14 is prevented from moving rearwardly out of the handle 12 by rearward edge 100 of rearward travel stop beam 94 abutting rear edge 47 of rear relief 46 and by the open lock edge 98 of lever arm 85 abutting rear edge 47. The blade 14 is prevented from moving forwardly (i.e., toward the extended position) by the abutting relationship between closed lock edge 96 abutting the shoulder 45 that defines the rear lock engagement 45. As best seen in the sectional views of FIGS. 8 and 11, with blade 14 in the retracted and locked position, actuation pad 84 lies above the plane defined by upper surface 70 of blade 14.

Blade 14 is moved out of the retracted and locked position of FIGS. 7, 8 and 11 by activation of the locking mechanism 82. Specifically, the user depresses actuation pad 84 by pushing it in the direction of arrow A in FIG. 8. As actuation pad 84 is thus pushed downwardly and the actuation pad moves into front lock relief 52, lever arm 85 pivots over rear fulcrum 48 against the counter force of spring beams 86 and 88 and this causes the rear end of the blade—open lock edge 98, to move in the opposite direction, arrow B in FIG. 8. As open lock edge 98 is thus moved upwardly (arrow B), closed lock edge 96 also moves upwardly and eventually clears rear lock engagement 45. Once closed lock edge 96 is clear of rear lock engagement 45, the blade may be slid forwardly toward the extended position in the direction of arrow C. The blade slides readily in the handle and is moved in the forward direction until shoulder 78 abuts closed end 42 of channel 34, and shoulder 80 abuts closed end 40 of channel 32, at which point forward travel of the blade relative to the handle stops. The shoulders 78 and 80 thus function as blade stops in conjunction with the closed ends 40 and 42 of the channels.

It will be appreciated that even when actuation pad 84 is depressed and open lock edge 98 clears rear lock engagement 45, the blade cannot be removed from the handle because rearward travel beam 94 remains in the position shown in FIG. 7 with its rearward edge 100 abutting rear edge 47.

With blade 14 in the extended position and shoulder 78 abutting closed end 42 of channel 34, and shoulder 80 abutting closed end 40 of channel 32, when pressure on actuation pad 84 is released, lever arm 85 pivots on front fulcrum 54 under the spring force of spring beams 86 and 88, causing open lock edge 98 to move into lock relief 52 with edge 98 abutting front lock engagement 55, thereby locking the blade securely in the extended position. In this position, rearward travel stop beam 94 is resting on and bearing against forward extension 53 of lateral shelf 57. In the extended and locked position, closed lock edge 96 abuts stepped edge 59 in lock relief 52. The blade dimensions and handle dimensions and tolerances between the various components and structures are adjusted so that the blade is wedged tightly and thus securely in this locked position to minimize relative movement between the blade and the handle.

Blade 14 is moved from the extended and locked position back to the retracted and locked position by again activating locking mechanism 82. With continuing reference to FIGS. 9 and 10, the user depresses actuator pad 84 by pressing in the direction of arrow A in FIG. 10, causing the actuation pad 84 to move into actuator relief 56. As this happens, lever arm 85 pivots on front fulcrum 54 against the counter force of spring beams 86 and 88 and this causes the rear end of the blade open lock edge 98, to move in the opposite direction of arrow B in FIG. 10. As open lock edge 98 is thus moved upwardly (arrow B), open lock edge 98 clears front lock engagement 55 and once it is clear, the blade may be slid rearwardly toward the retracted position in a direction opposed to the direction of arrow C. The blade is slid in the rearward direction until the rearward edge 100 of rearward travel stop beam 94 abuts edge 47, where travel in that direction is stopped. At this point, or before if the user chooses to release pressure on actuation pad 84 earlier, the locking mechanism moves into the retracted and locked position shown in FIGS. 7, 8 and 11.

The knife 10 includes structures that allow the blade to be disassembled from the handle and removed, for example to clean the blade and handle, and to facilitate sharpening of the blade. When blade 14 is in the retracted and locked position shown in FIGS. 7, 8 and 11, the rear portion of rearward travel stop beam 94 overlies disassembly hole 62. The blade 14 may be removed from the handle by the user inserting a probe through disassembly hole 62 from the back side of the handle (i.e., the side of the handle shown in FIG. 1) and deflecting rearward travel stop beam 94 upwardly (in the direction of arrow B, FIG. 8) until rearward edge 100 clears adjacent rear edge 47. With the rearward travel stop beam 94 thus released, the locking mechanism 82 is simultaneously actuated as detailed above so that open lock edge 98 clears edge 47 and the blade may be slid in the rearward direction and removed. The blade is easily reinserted into the handle, and of course a blade such as that shown in the present invention may be interchanged with a tool having a different type of working portion, such as a divot repair tool.

Those of skill in the art will readily recognize that there are numerous variations and alternatives to the knife described above that may be constructed, yet which are equivalent to the embodiments already described. To characterize just a few examples, the closed lock edge 96 may be eliminated and replaced with a different mechanism to retain the blade in the closed position. Numerous mechanisms beside closed lock edge 96 may be used to retain the blade in the closed position. For example, a ball and detent in which the ball is formed in either the handle or the blade and which engages a detent in the opposing structure operates to retain the blade relative to the handle, but does not "lock" the two pieces together. Similarly, tabs and recesses may be formed in cooperative parts of the rails and channels to retain the blade to the handle.

It is further possible to form the blade with working portions on both ends of the blade and construct the handle so that the blade is longitudinally slidable into and out of both ends. For example, one end of the blade may be sharpened as described above and the opposite end of the blade could define a tool such as a can opener. By eliminating the rearward travel stop beam 94, the blade may be moved longitudinally out both ends of the handle, thereby providing the additional functionality of a second type of blade. The handle would be modified in order to provide a lock for the blade in both of the open positions, and in the closed position.

Finally, the means by which the blade is retained to the handle described above (i.e., the rails on the blade cooperating with the channels in the handle) may be replaced with other equivalent structures such as longitudinal slots formed in the handle and legs formed on the blade that are inserted into the slots and which have L-shaped portions on the ends of the legs to retain the blade to the handle yet allow relative movement therebetween.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. A knife, comprising:

a handle having opposed lateral channels and a blade groove therebetween;

a blade slidably received in the blade groove for longitudinal movement in the blade groove relative to the handle, the blade having a working portion and a first rail on one lateral side of the blade and a second rail on the opposite lateral side of the blade, each of said opposed lateral channels of the handle configured for receiving one of said rails, and said blade movable between a retracted position in which the working portion of the blade is stowed in the handle and an extended position in which the working portion is exposed;

said blade further comprising a lock configured for locking the blade to the handle in both the retracted and extended positions;

in which the blade groove defines a plane at a first elevation;

wherein the lock is defined by a lever arm formed in the blade, the lever arm having an actuating pad at a first end and attached at a second end to opposed spring arms, and the blade further including an open lock edge rearward of the actuating pad and a closed lock edge;

and wherein when the knife is in the retracted and locked position the open lock edge and the closed lock edge are positioned in a recessed area in the handle below the first elevation.

2. The knife according to claim 1 wherein when the knife is in the retracted and locked position the closed lock edge engages a shoulder in the recessed area to prevent movement from the retracted position.

3. The knife according to claim 2 including a first fulcrum in the handle at the first elevation, and wherein when the blade is in the retracted and locked position the lever arm rests on the first fulcrum.

4. The knife according to claim 3 wherein each of said opposed lateral channels defines a blade stop and each of said rails defines a shoulder that interacts with a respective blade stop to stop movement of the blade in the extended position.

5. The knife according to claim 4 wherein when the knife is in the extended and locked position the open lock edge abuts a stop edge formed in the handle to prevent the blade from moving from the extended position toward the retracted position.

6. The knife according to claim 5 including a second fulcrum in the handle at the first elevation, and wherein when the blade is in the extended and locked position the lever arm rests on the second fulcrum.

7. The knife according to claim 1 wherein the recessed area includes a rearward stop edge and the blade includes a stop beam having a stop beam rear edge residing in the recessed area and abutting the rearward stop edge.

8. The knife according to claim 7 wherein the blade is removable from the handle through a rear edge thereof by actuation of the lock so that the open lock edge disengages the rearward stop edge and deflection of the stop beam so that the stop beam rear edge disengages the rearward stop edge.

9. The knife according to claim 1 in which the handle is monolithic.

10. The knife according to claim 9 in which the blade is monolithic.

11. A knife, comprising:

a handle having opposed lateral sides, each of the lateral sides defining blade receiving means for receiving a blade and for retaining said blade relative to said handle, said handle further defining a blade groove between the blade receiving means;

a blade longitudinally received in the handle and movable in the blade groove between a retracted position and an extended position, said blade having opposed lateral side edges, each lateral side edge received in a respective blade receiving means; and said blade incorporating lock means for locking said blade to handle in the both the retracted and extended positions;

in which the lock means is an integral part of the blade;

in which the blade is monolithic, wherein each blade receiving means is defined by an inwardly-open channel formed in each of the lateral sides, each channel having a blade stop at a forward end thereof;

and wherein each of the opposed lateral side edges of the blade further includes a shoulder portion that interacts with the blade stops to prevent movement of the blade relative to the handle when the blade is in the extended position.

12. The knife according to claim 11 wherein the lock means is defined by a lever arm formed in the blade, the lever arm having an actuating pad at a first end and attached at a second end to opposed spring arms, and the blade further including an open lock edge rearward of the actuating pad and a closed lock edge, and wherein when the knife is in the retracted and locked position the open lock edge and the closed lock edge are positioned in a recessed area in the handle.

* * * * *